US007285017B2

(12) United States Patent
Mitra et al.

(10) Patent No.: US 7,285,017 B2
(45) Date of Patent: Oct. 23, 2007

(54) CABLE CONNECTOR AND METHOD OF ASSEMBLING A CABLE TO SUCH A CABLE CONNECTOR

(75) Inventors: Niranjan Kumar Mitra, Eindhoven (NL); Gert Droesbeke, Geel (BE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/539,927

(22) PCT Filed: Dec. 12, 2003

(86) PCT No.: PCT/EP03/50993

§ 371 (c)(1),
(2), (4) Date: Jun. 30, 2006

(87) PCT Pub. No.: WO2004/057707

PCT Pub. Date: Jul. 8, 2004

(65) Prior Publication Data

US 2007/0021005 A1 Jan. 25, 2007

(30) Foreign Application Priority Data

Dec. 20, 2002 (NL) ..... 1022225

(51) Int. Cl.
*H01R 9/03* (2006.01)

(52) U.S. Cl. ..... 439/610

(58) Field of Classification Search ..... 439/608, 439/610

See application file for complete search history.

(56) References Cited

U.S. PATENT DOCUMENTS 4,653,836 A * 3/1987 Peele ..... 439/610
4,902,242 A * 2/1990 Davis et al. ..... 439/404
4,960,392 A * 10/1990 Dickie ..... 439/620.05
5,167,523 A * 12/1992 Crimmins et al. ..... 439/350
5,195,909 A * 3/1993 Huss et al. ..... 439/465
5,244,415 A * 9/1993 Marsilio et al. ..... 439/610
5,372,513 A * 12/1994 Rodrigues et al. ..... 439/98
5,387,130 A * 2/1995 Fedder et al. ..... 439/610
5,409,400 A * 4/1995 Davis ..... 439/610
5,505,637 A * 4/1996 Kramer et al. ..... 439/610

(Continued)

FOREIGN PATENT DOCUMENTS

EP 1 067 635 A1 1/2001

(Continued)

*Primary Examiner*—Ross Gushi
(74) *Attorney, Agent, or Firm*—Harrington & Smith, PC

(57) ABSTRACT

The invention relates to a cable connector including a housing having a die-cast base substantially extending between a front side and a rear side of the connector. The connector further includes a die-cast first housing part mounted to the die-cast base such that the die-cast first housing part and a first portion of the die-cast base determine a first cable connector portion at the rear side. The cable connector further includes a metal sheet formed second housing part mounted to the die-cast base such that the metal sheet formed second housing part and a second portion of the die-cast base determine a second cable connector portion at the front side. The cable connector is suited as a high density I/O cable connector. The invention further relates to a method of assembling a cable to such a cable connector and a metal sheet formed housing part.

28 Claims, 9 Drawing Sheets

U.S. PATENT DOCUMENTS

| | | | | | |
|---|---|---|---|---|---|
| 5,564,940 | A * | 10/1996 | Rodriques et al. | 439/404 |
| 5,755,597 | A * | 5/1998 | Panis et al. | 439/610 |
| 5,831,815 | A * | 11/1998 | Miller et al. | 361/679 |
| 6,007,384 | A * | 12/1999 | Kraemer et al. | 439/610 |
| 6,017,245 | A * | 1/2000 | Karir | 439/610 |
| 6,019,627 | A * | 2/2000 | Embo et al. | 439/412 |
| 6,036,543 | A * | 3/2000 | Panis et al. | 439/607 |
| 6,146,205 | A * | 11/2000 | Lai | 439/610 |
| 6,203,377 | B1 * | 3/2001 | Grek et al. | 439/610 |
| 6,217,364 | B1 * | 4/2001 | Miskin et al. | 439/358 |
| 6,224,423 | B1 * | 5/2001 | Yip et al. | 439/608 |
| 6,231,392 | B1 * | 5/2001 | van Woensel | 439/610 |
| 6,270,382 | B1 * | 8/2001 | Droesbeke et al. | 439/701 |
| 6,328,601 | B1 * | 12/2001 | Yip et al. | 439/608 |
| 6,386,919 | B2 * | 5/2002 | Medina et al. | 439/610 |
| 6,428,359 | B2 * | 8/2002 | Van Zanten | 439/610 |
| 6,565,388 | B1 * | 5/2003 | Van Woensel et al. | 439/610 |
| 6,582,244 | B2 * | 6/2003 | Fogg et al. | 439/362 |
| 6,582,255 | B2 * | 6/2003 | Simmons et al. | 439/701 |
| 6,599,151 | B2 * | 7/2003 | Chiran et al. | 439/610 |
| 6,629,858 | B2 * | 10/2003 | Lo et al. | 439/607 |
| 6,705,894 | B1 * | 3/2004 | Comerci et al. | 439/607 |
| 6,887,091 | B1 * | 5/2005 | Wu | 439/352 |
| 2001/0055909 | A1 * | 12/2001 | Van Zanten | 439/610 |
| 2002/0025722 | A1 * | 2/2002 | Inagawa et al. | 439/610 |
| 2002/0146926 | A1 * | 10/2002 | Fogg et al. | 439/362 |
| 2006/0105632 | A1 * | 5/2006 | Szczesny et al. | 439/610 |
| 2007/0037437 | A1 * | 2/2007 | Wu | 439/449 |
| 2007/0037450 | A1 * | 2/2007 | Wu | 439/610 |

FOREIGN PATENT DOCUMENTS

| | | |
|---|---|---|
| EP | 1 115 182 A1 | 7/2001 |

* cited by examiner

CABLE CONNECTOR AND METHOD OF ASSEMBLING A CABLE TO SUCH A CABLE CONNECTOR

FIELD OF THE INVENTION

The invention relates to a cable connector comprising a housing having a die-cast base substantially extending between a front side and a rear side of said connector.

BACKGROUND OF THE INVENTION

Nowadays, cable connectors in e.g. telecom applications have to meet a package of ever increasing requirements relating to e.g. robustness, quality of assembly, aesthetical considerations, density, shielding etc.

U.S. Pat. No. 6,217,364 discloses an electrical connector assembly, wherein the housing of the electrical connector comprises two halves of die-cast metal material extending between a front opening and a rear opening. An electrical cable includes a plurality of electrical wires that are terminated to a plurality of wafers juxtaposed in a parallel array that is positioned in one of the housing halves.

A problem associated with the prior art cable connector is that the housing is manufactured from die-cast metal material which results in a minimum thickness for the walls of the connector housing. Connection panels comprising header assemblies for a cable connector have openings for insertion of cable connectors. The dimensions of these openings are decreasing to obtain a high density, such that limitation of the minimum wall thickness of a housing of a cable connector constitutes a constraint with respect to the density of cable connectors on such a connection panel.

SUMMARY OF THE INVENTION

It is an object of the invention to provide a cable connector with an improved density performance.

This object is achieved by providing a cable connector characterized by:

a die-cast first housing part mounted to said die-cast base such that said die-cast first housing part and a first portion of said die-cast base determine a first cable connector portion at said rear side;

a metal sheet formed second housing part mounted to said die-cast base such that said metal sheet formed second housing part and a second portion of said die-cast base determine a second cable connector portion at said front side.

Such a cable connector combines a die-cast base with a metal sheet formed housing part at the front side. The metal sheet formed housing part provides the possibility to limit the front side wall thickness of the cable connector housing, such that the front side of this cable connector can be inserted in a connecting panel with openings of smaller dimensions, while still using die-cast parts. Die-cast parts generally allow a large freedom with respect to shapability of such a part. The die-case base which extends between the front side and the back side of the entire housing provides rigidity to this cable connector. As an additional advantage, such a cable connector can be easily provided with polarization features for insertion in a header, since the die-cast edge at the front side can be manufactured with sharp contours, while the metal sheet formed housing part edge at the front side will have more smooth contours.

In a preferred embodiment of the invention, the die-cast first housing part is a modular first housing part and the first cable connector portion is a ferrule holder portion. Since the first cable connector portion may be constituted solely of die-cast metal parts, this portion may have a complex shape with several protrusions, slots, recesses etc. As a result a robust first connector portion is obtained, which may meet aesthetical requirements. Requirements relating to robustness and aesthetics are particularly relevant for I/O cable connectors. Moreover, by having a modular first housing part, i.e. the first housing part is a separate component, a cable can be positioned in the complex formed die-cast base, such that a ferrule associated with this cable can be fixed in the ferrule holder by subsequently mounting the separate die-cast first housing part to the die-cast base. The first cable connector portion further may have a shaft protruding outwardly from the first connector portion to protect the cable from getting punctured by sharp edges of the housing.

In a preferred embodiment of the invention the metal sheet formed second housing part is a modular second housing part and said second portion of the die-cast base comprises a receiving structure for the second housing part. The receiving structure is arranged such that the dimensions of the cable connector at the front side can be kept to a minimum to enable high density. Preferably the wall thickness of at least the part of the second portion to be inserted in the opening in the connecting of said die-cast base is approximately 0.4-0.6 mm. This is about the minimum limit for reliable die-casting structures.

In a preferred embodiment of the invention the second cable connector portion comprises an opening at the front side and the connecting means are substantially located within the second cable connector portion. The withdrawn location of the connecting means from the front side provides the advantage of robustness, since the connecting means are well protected and hold tightly within the housing. Furthermore the connecting means are prevented from twisting or rotating with respect to the cable connector.

In a preferred embodiment the die-cast base may comprise a wire management portion and/or a connecting means portion with reception means adapted for receiving the connecting means. These reception means can be easily obtained in the die-cast process of manufacturing the die-cast base. The reception means preferably are adapted to cooperate with protrusion or holes in the connecting means. Further the connecting means may comprise one or more individual or stacked wafers for termination of the cable wires comprising holes to cooperate with the protrusions and/or reception means. Such an arrangement of connecting means facilitates assembly of the cable connector as individual as well as stacked wafers and connecting blocks can be applied in the connecting means portions employing, mounting or fitting the corresponding reception means, protrusions, holes on the various connector parts and connecting means. The reception means may e.g. be a pillar running through the connecting means and fixed at both ends in the die-cast base and the metal sheet formed second housing part.

In a preferred embodiment of the invention, the die-cast base comprises one or more ridges. Since the die-cast base preferably has a wall thickness close to the minimum wall thickness that can be obtained in the die-cast process, the ridges provide mechanical strength or robustness to at least the thin die-cast base portion. Preferably the ridges are located in at least a part of the second portion of said die-cast base and extend in an axial direction of the cable connector. More preferably the ridges are located in the wire management portion. The ridges can be easily obtained in the die-cast process of manufacturing the die-cast base. By providing these ridges at least in the wire management section, the ridges moreover may assist in management of the cable wires terminating at the first wafer of the stack in the connecting means portion. The ridges may have one or more protrusions extending from the ridge in a direction substantially perpendicular to the axial direction as to assist in cable wire management for wires terminating at subsequent wafers of the stack in the connecting means portion. Wire management of the cable wires is e.g. needed to guide the cable wires from the e.g. spherical arrangement in the cable to the matrix arrangement of the connecting block of the connecting means.

In a preferred embodiment the metal sheet formed housing part comprises spring contacts adapted to be received in the first portion of the die-cast base. The die-cast base, the die-cast first housing part and the metal sheet formed second housing part may all be finished products satisfying particular tolerance requirements. These spring contacts allow absorption of mutual tolerances and provide adequate electrical connection between the die-cast base and the metal sheet formed housing part for shielding, since the die-cast base, the die-cast first housing part and the metal sheet formed second housing part are squeezed together and with the ferrule of the cable.

It should be appreciated that the embodiments discussed above, or aspects thereof, can be combined.

The invention also relates to a method of assembling a cable to a cable connector as discussed above, comprising the steps of:

providing a cable having a cable ferrule in said first portion of said die-cast base;

mounting said metal sheet formed second housing part to said second portion of said die-cast base;

mounting said die-cast first housing part to said first portion of said die-cast base while clamping protrusions of said metal sheet formed second housing part between said cable ferrule and said die-cast first housing part.

By providing an appropriately internally shaped die-cast base, the cable can be easily inserted into the housing and a rigid connector housing is obtained when both the metal sheet formed part and the first die-cast housing part are mounted to the die-cast base.

The cable connector may comprise connecting means at the front side with one or more wafers, wherein the wafers comprise a plurality of signal tracks and/or ground tracks for termination of the cable wires. In a preferred embodiment of the method the cable wires are cut to an appropriate length with respect to the signal tracks after positioning the ferrule in said die-cast base. This provides the advantages that the housing may function as an appropriate reference, such that the cable wires can be easily cut to their required length. The cable wires may be cut to be slightly larger than the axial distance between the ferrule and the wire termination parts of the signal tracks, such that forces applied on the cable or the wires are not transferred to the solder points of the wires on these signal tracks.

The invention also relates to a metal sheet formed housing part of a cable connector, said cable connector further comprising a die-cast base substantially extending between a front side and a rear side of said cable connector and a die-cast housing part adapted to be mounted to said die-cast base, wherein said metal sheet formed housing part is adapted to be mounted to said die-cast base and said die-cast housing part.

This metal sheet formed housing part allows for a high density cable connector with a rigid base. Such a housing part can be manufactured easily.

Preferably, the metal sheet formed housing part comprises protrusions for mounting this housing part to the die-cast first housing part. The metal sheet formed housing part may have a U-shape.

BRIEF DESCRIPTION OF THE DRAWINGS

The invention will be further illustrated with reference to the attached drawing, which shows a preferred embodiment according to the invention. It will be understood that the cable connector according to the invention is not in any way restricted to this specific and preferred embodiment.

DETAILED DESCRIPTION OF THE INVENTION

Figure 1:
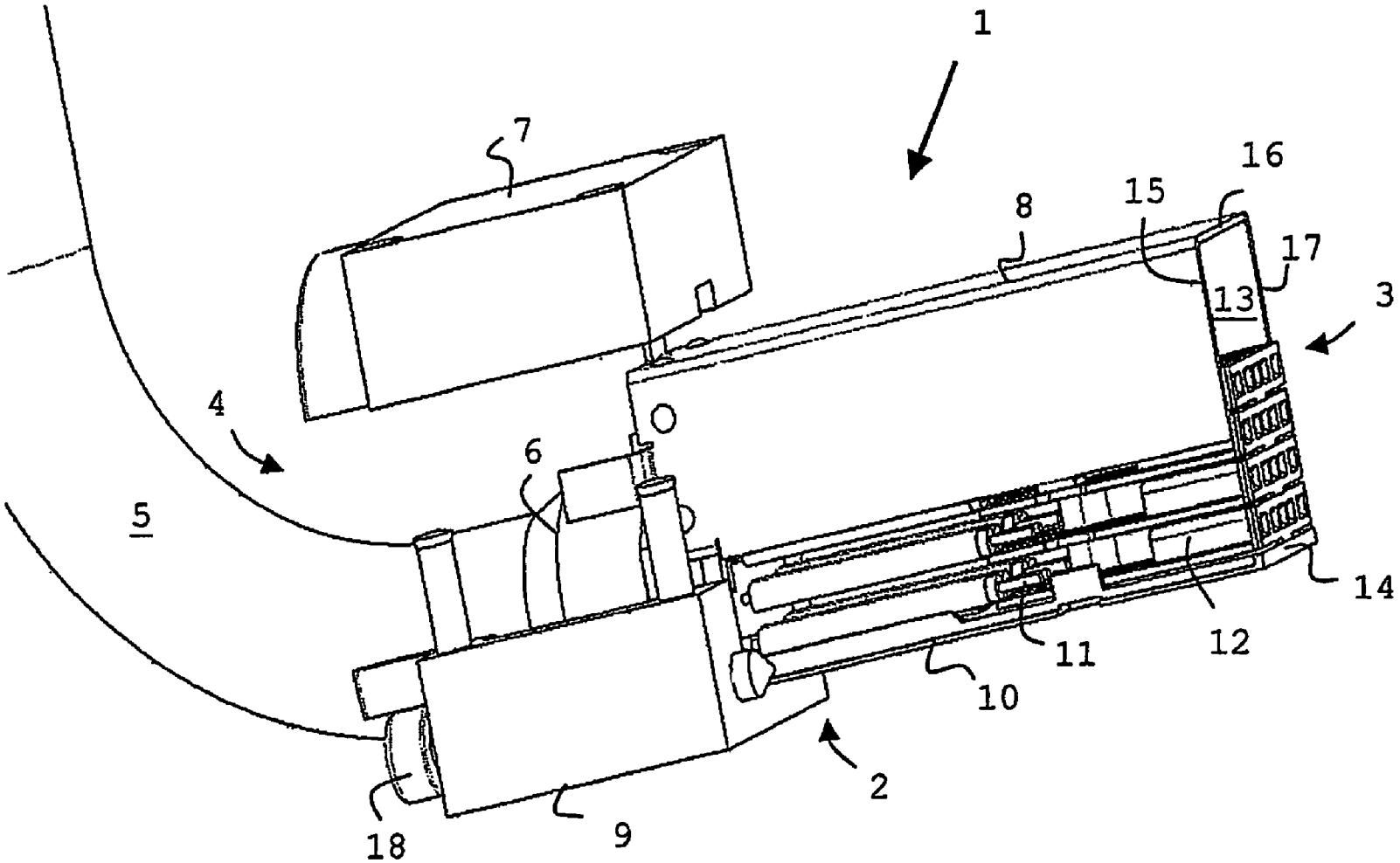
FIG. 1 shows a cable connector according to an embodiment of the invention.

In FIG. 1 an I/O 8-pair twinax cable connector 1 is shown, comprising a die-cast base 2, hereinafter also referred to as base 2, extending between a front side 3 and a rear side 4. A cable 5 provided with a ferrule arrangement 6 is assembled to the connector 1 at the rear side 4. The connector 1 further comprises a die-cast first housing part 7 and a metal sheet formed second housing part 8, which housing parts 7, 8 are not mounted to the base 2 for clarity purposes in FIG. 1. Housing parts 7 and 8 are modular parts, i.e. they are separate components adapted to engage with the base 2. Base 2 comprises a first portion 9 and a second portion 10 determining a first cable connector portion or ferrule portion with the first housing part 7 and a second connector portion with the second housing part 8 respectively. The second portion 10 comprises a wire management portion and a connecting means portion (indicated in FIG. 3) comprising cable wires 11 and connecting means 12, the latter exposed at the front side 3 of the cable connector 1 where an opening 13 is determined by an edge 14 of the second base portion 10 and the edges 15, 16, 17 of the second housing part 8. Edge 14 may be given a sharp contour, while edges 15, 16 and 17 of the second housing part 8 will have more smooth contours, providing polarization for insertion in a panel as e.g. shown in FIG. 2. The connecting means 12 are substantially located within the second cable connector portion. In FIG. 1 the connecting means 12 are located within the second cable connector portion with respect to the edge 14 of the die-cast base 2 and the edge 16 of the second housing part 8, while the connecting means 12 do slightly protrude from the second cable connector portion with respect to the edges 15 and 17. Finally the cable connector 1 comprises a screw 18 for mounting the cable connector to a panel or element thereof such as a header assembly. Detailed parts of the cable connector 1 will be discussed in relation to the FIGS. 3-8 showing detailed views of the cable connector.

Figure 2:
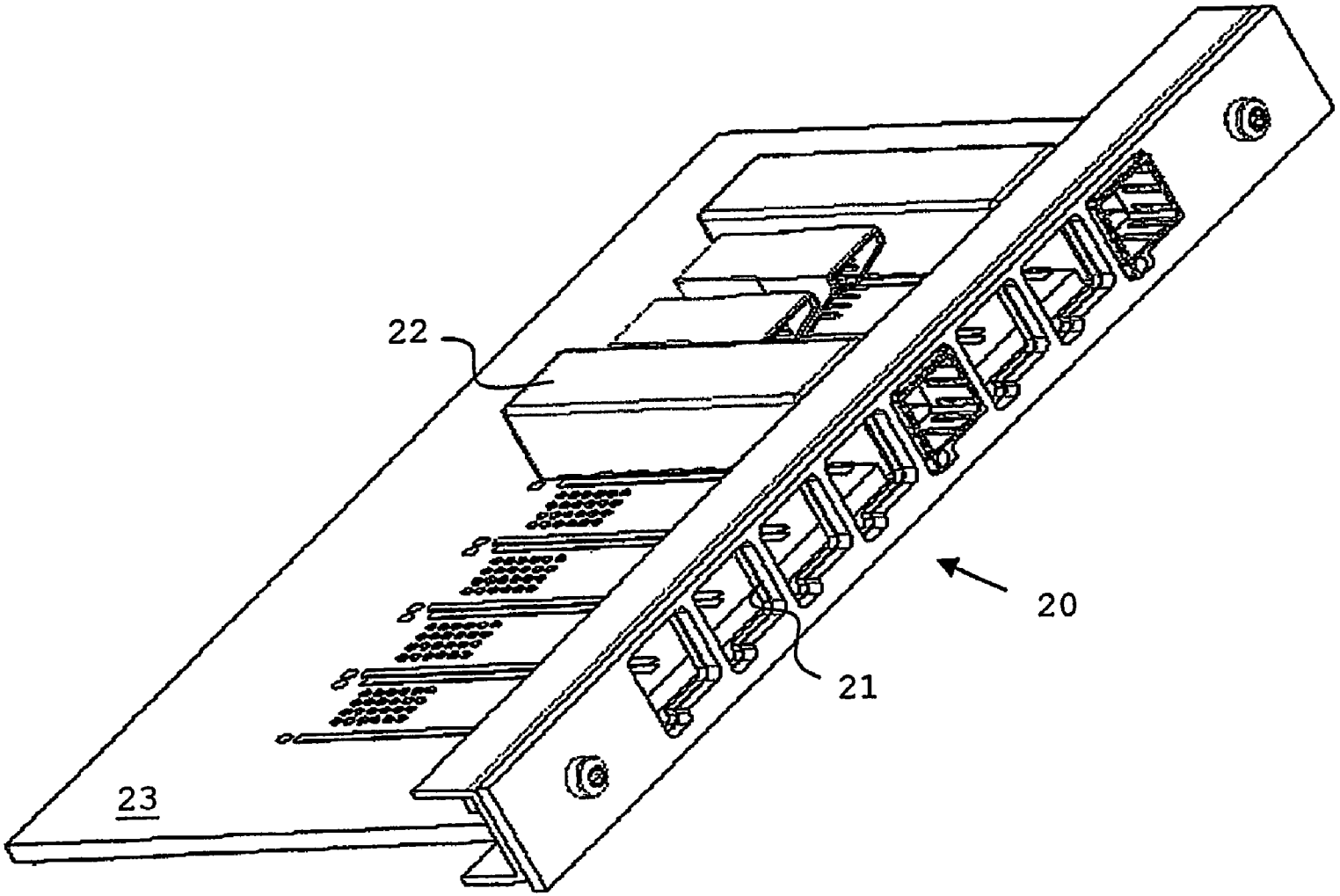
FIG. 2 shows a part of a connecting panel comprising header assemblies for connecting a cable connector according to an embodiment of the invention.

FIG. 2 shows a front connecting panel 20 having cut-out openings 21 for insertion of the second cable connector portions of the cable connector 1 as shown in FIG. 1 in header assemblies 22 connected to a board 23. Header assemblies 22 are subject of a co-pending application ("shielding cage") of the applicant of the same date. Openings 21 of the high density front panel 20 e.g. have a height of 7.4 mm and a width of 8.3 mm. Since the connecting means 12 requires a given amount of space, only base 2 of cable connector 1 may be of die-cast metal with a wall thickness of e.g. 0.6 mm. According to the invention the second housing part 8 is a metal sheet formed housing part allowing a thinner wall, such as e.g. 0.3 mm.

The first cable connector portion or ferrule portion is not to be inserted in the opening 21 as a consequence of which this connector portion may be entirely of die-cast metal. Therefore this connector portion is robust and can be nicely shaped, making cable connector 1 appropriate to function as an I/O connector.

Figure 3:
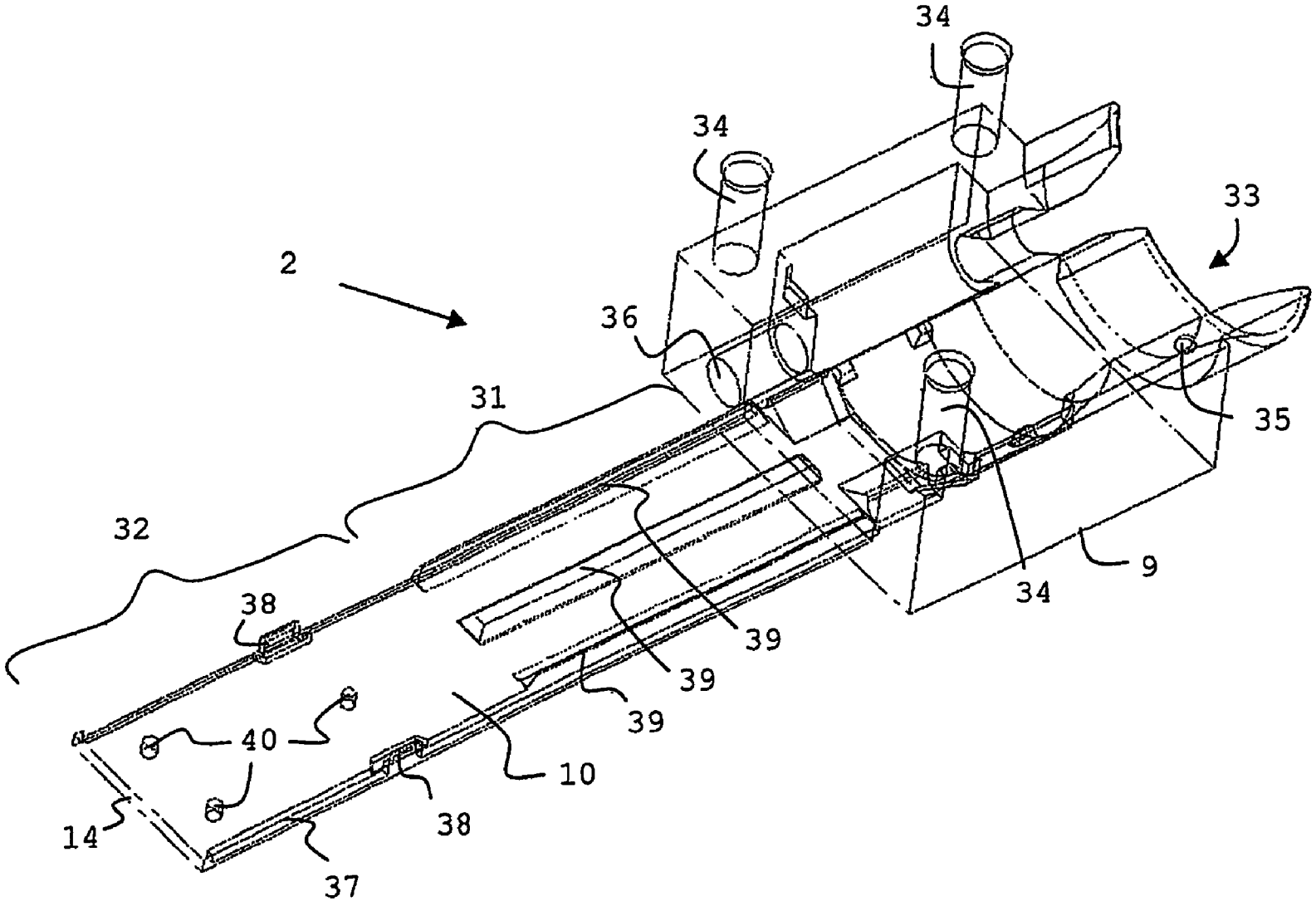
FIG. 3 shows a die-cast base of a cable connector according to an embodiment of the invention.

FIG. 3 shows a detailed view of the die-cast base 2 of the cable connector 1 as shown in FIG. 1. Base 2 comprises a first portion 9 and a second portion 10, the latter being divided in a wire management portion 31 and a connecting means portion 32. The first portion 9 comprises a cable entrance opening 33 and a internal structure. This structure e.g. comprises a structure to hold the ferrule arrangement 6 of the cable 5. The first portion 9 further comprises upstanding pillars 34 and a bubble 35 to receive the die-cast first housing part 7, as a consequence of which rigidity of the cable connector 1 is achieved or enhanced. Furthermore first portion 9 comprises an integral structure 36 adapted for accommodation of screw 18. The required high density performance of the cable connector 1 may allow for accommodation of only one screw 18.

The second portion 10 of base 2 comprises a receiving structure 37 to accommodate edges 41 and 42 (shown in FIG. 4) of the metal sheet formed second housing part 8 such that the outer dimensions of the front side 3 of the cable connector 1 can be kept to a minimum such that the second cable connector portion can be inserted in the openings 21 of a high density panel 20, shown in FIG. 2. Receiving structure 37 may be a step-like structure. Moreover the second portion 10 comprises mounting structures 38 to cooperate with mounting structures 43 (shown in FIG. 4) of the second housing part 8 for fixating the second housing part 8 with the base 2, e.g. by snap-fitting.

Wire management portion 31 of second portion 10 comprises ridges 39 along an axial direction of the base 2. Ridges 39 provide mechanical strength to the slender die-cast base portion 10, which has a minimum thickness of e.g. 0.6 mm. It should be appreciated that ridges 39 may also extend to e.g. the end of base portion 10, i.e. up to edge 14, as to support the connecting means 12, or an alternative length. Moreover, ridges 39 may facilitate management of the cable wires 11 of the cable 5 by substantially matching the outer profiles of the cable wires 11 thereby orienting properly the wire pairs from the first connector portion to the connecting means 12. In the embodiment shown in FIG. 3, ridges 39 may only manage the cable wires 11 for a first wafer of the stack of connecting means 11 in connecting means portion 32. However, since ridges 39 are manufactured in a die-cast process, these ridges may be formed with protrusions (not shown) extending in a direction substantially perpendicular to the axial direction, such that cable wires 11 of subsequent wafers in the stack in the connecting means portion 32 can be influenced as well. The length of the wire management portion 31 may depend on the diameter of the cable 5, such as e.g. 15 mm for an AWG26 cable. The wires 11 of the cable 5 are partially stripped and terminated on appropriate parts of the connecting means 12. The lengths of the wires 11 may be cut slightly larger than the distance between the end of the ferrule arrangement 6 and the wire termination part of the connecting means 12, to avoid transfer of mechanical forces to these termination parts if forces are applied to the cable 5.

Connecting means portion 32 of base 2 may comprise reception means 40 for receiving elements of the connecting means 12, which will be described in FIGS. 6-8 in more detail. Reception means 40 may comprise one or more pillars and/or holes adapted to receive separate pillars or protrusions (shown in FIGS. 6-8) of the connecting means 12.

Figure 4:
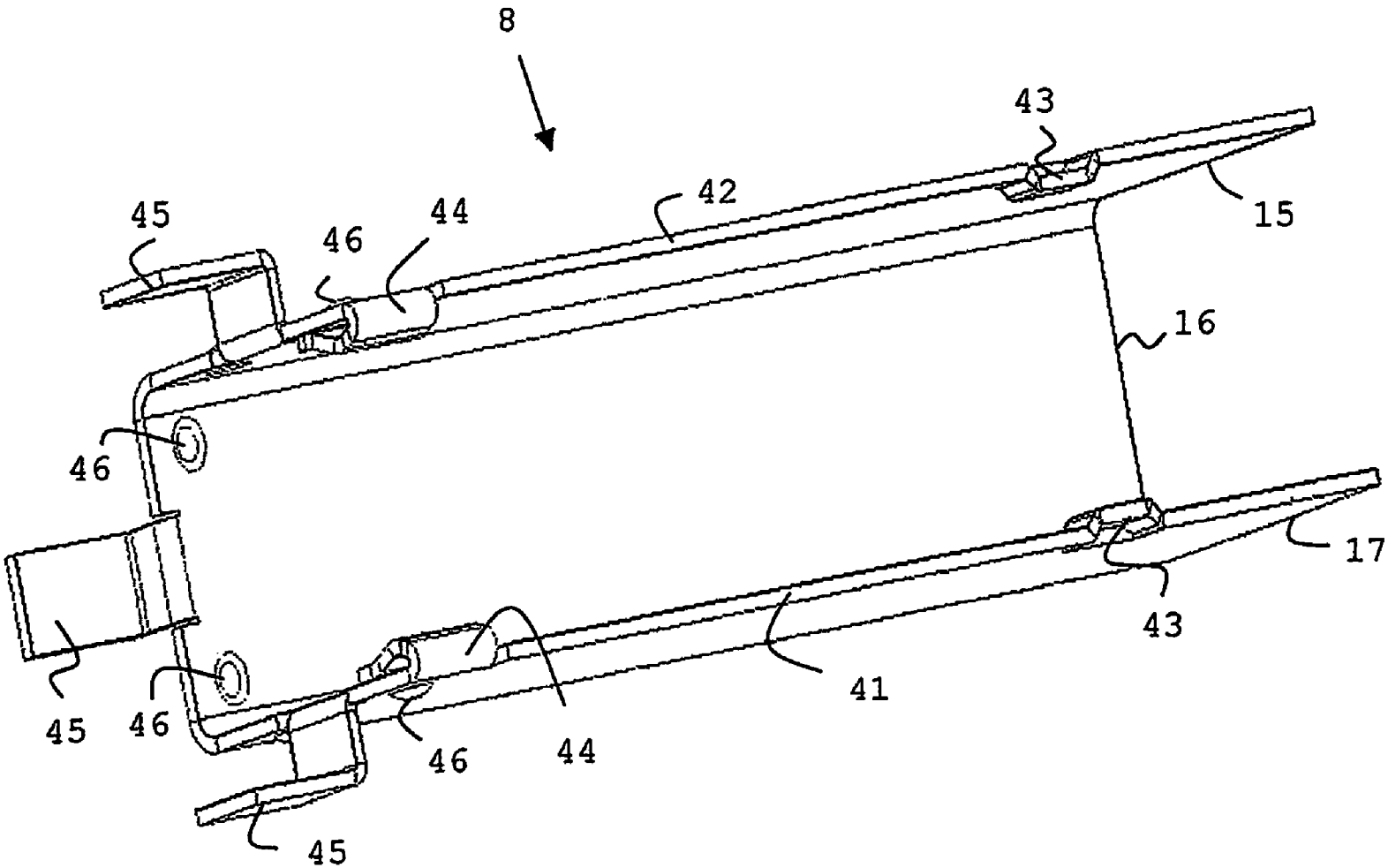
FIG. 4 shows a metal sheet formed second housing part for a cable connector according to an embodiment of the invention.

FIG. 4 displays a metal sheet formed second housing part 8 as a U-shaped housing part determined by edges 15, 16 and 17 and elongated in an axial direction of the cable connector 1 by edges 41 and 42. Housing part 8 comprises mounting structures 43 that are adapted to cooperate with mounting structures 38 of the second portion 10 of base 2. Housing part 8 further comprises spring contacts 44 that cooperate with the internal structure of the first portion 9 of base 2 if the cable connector 1 is assembled. This part of the internal structure of first portion 9 is e.g. a curvilinear surface against which the spring contacts 44 are pressed. Spring contacts 44 are preferably be formed integral to the housing part 8 and absorb tolerances and provide reliable electrical contact between the die-cast base 2 and the housing part 8. Further housing part 8 comprises protrusions 45 that are sandwiched between the ferrule arrangement 6 and the die-cast first housing part 7 while assembling the cable connector 1. Moreover housing part 8 comprises dimples 46 for forcing the housing part 8 towards the base 2 when mounting the first housing part 7.

Figure 5:
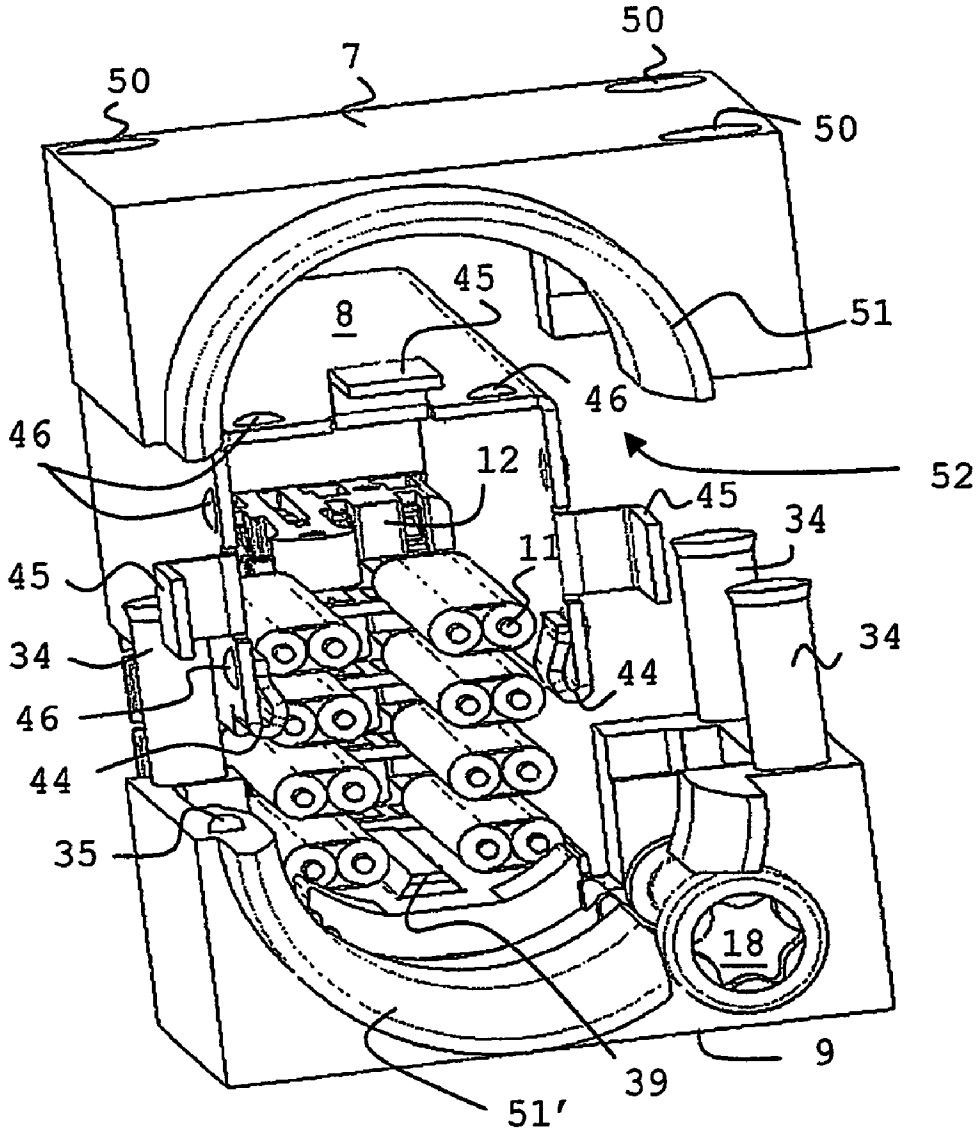
FIG. 5 shows a rear view section of a cable connector as shown in FIG. 1.

FIG. 5 shows a rear view of the cable connector 1 as shown in FIG. 1, without cable 5, but with cable wires 11. FIG. 5 shows the connecting means 12 in a twinax matrix configuration. Elements already discussed previously have been assigned identical reference numbers. The first connector portion or ferrule portion constituted by the die-cast first housing part 7 and the first portion 9 of the die-cast base 2 dimensions of e.g. 12 mm in width and 14 mm in height, i.e. significantly larger than the dimension of the second cable connector portion that is to be inserted in the small opening 21 of the panel 20. The die-cast first housing part 7 receives the protrusions 45 at the side of the metal sheet formed second housing part 8. The protrusions 45 are flexible to built up contact pressure and reliable electrical contact with the ferrule arrangement 6.

The die-cast first housing part 7 comprises holes 50 for reception of the pillars 34 of the die-cast base 2 to achieve or enhance rigidity to the cable connector 1. Moreover, a shaft 51, 51' protrudes from the opening 52 of the first cable connector portion to support the mantle of the cable 5 over length of the shaft such that severe bending of the cable 5 does not result in puncture of the sharp edges of the housing in the mantle. Such severe bending is e.g. imposed to the cable 5 if such a cable 5 is routed in a standardized cabinet space of 38 mm. The cable connector 1 may be suited for cable diameters with a maximum of e.g. 9.3 mm.

Figure 6:
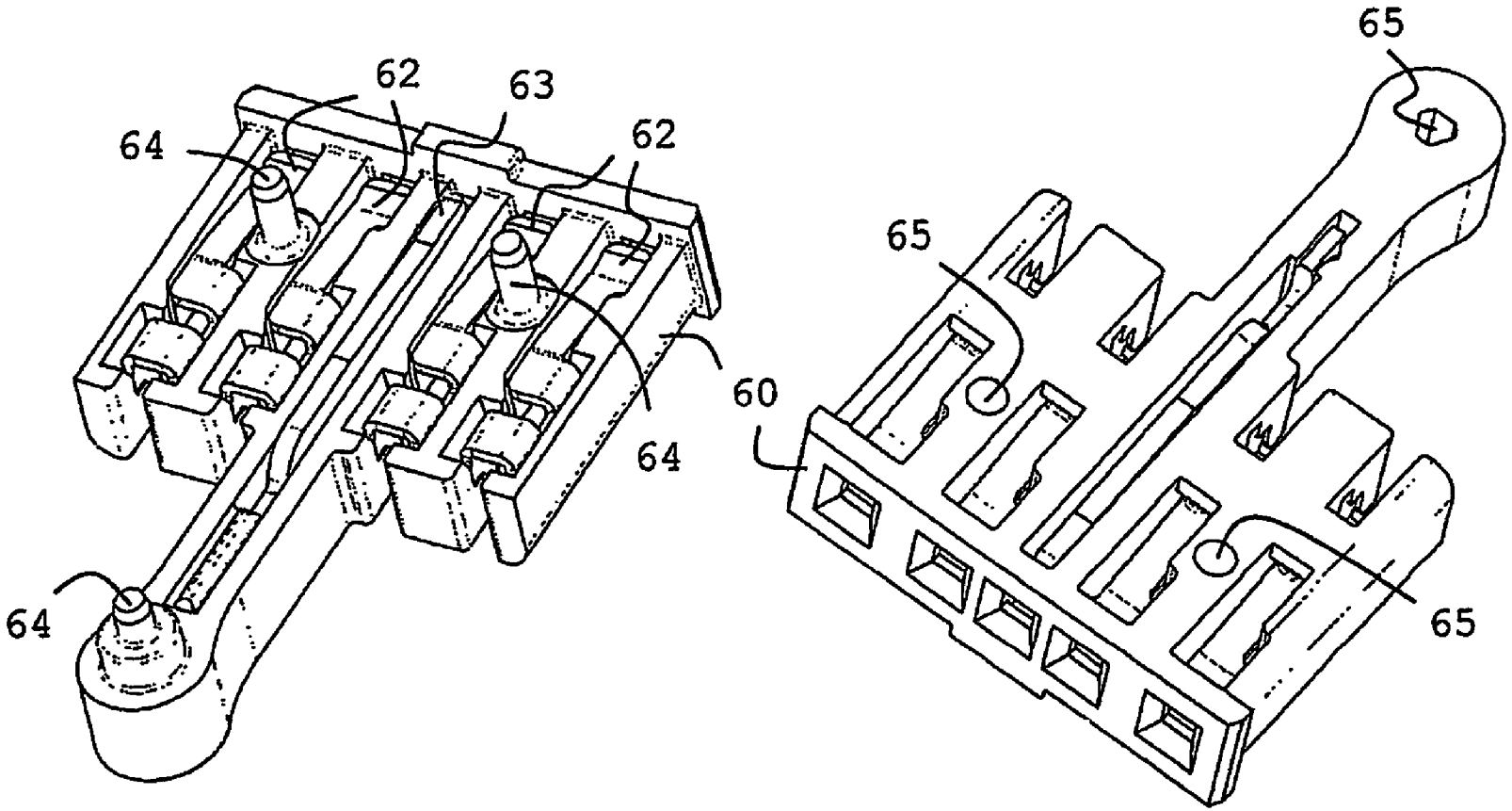
FIGS. 6-8 show embodiments of connecting means that may be applied in a cable connector as shown in FIG. 1.
Figure 7:
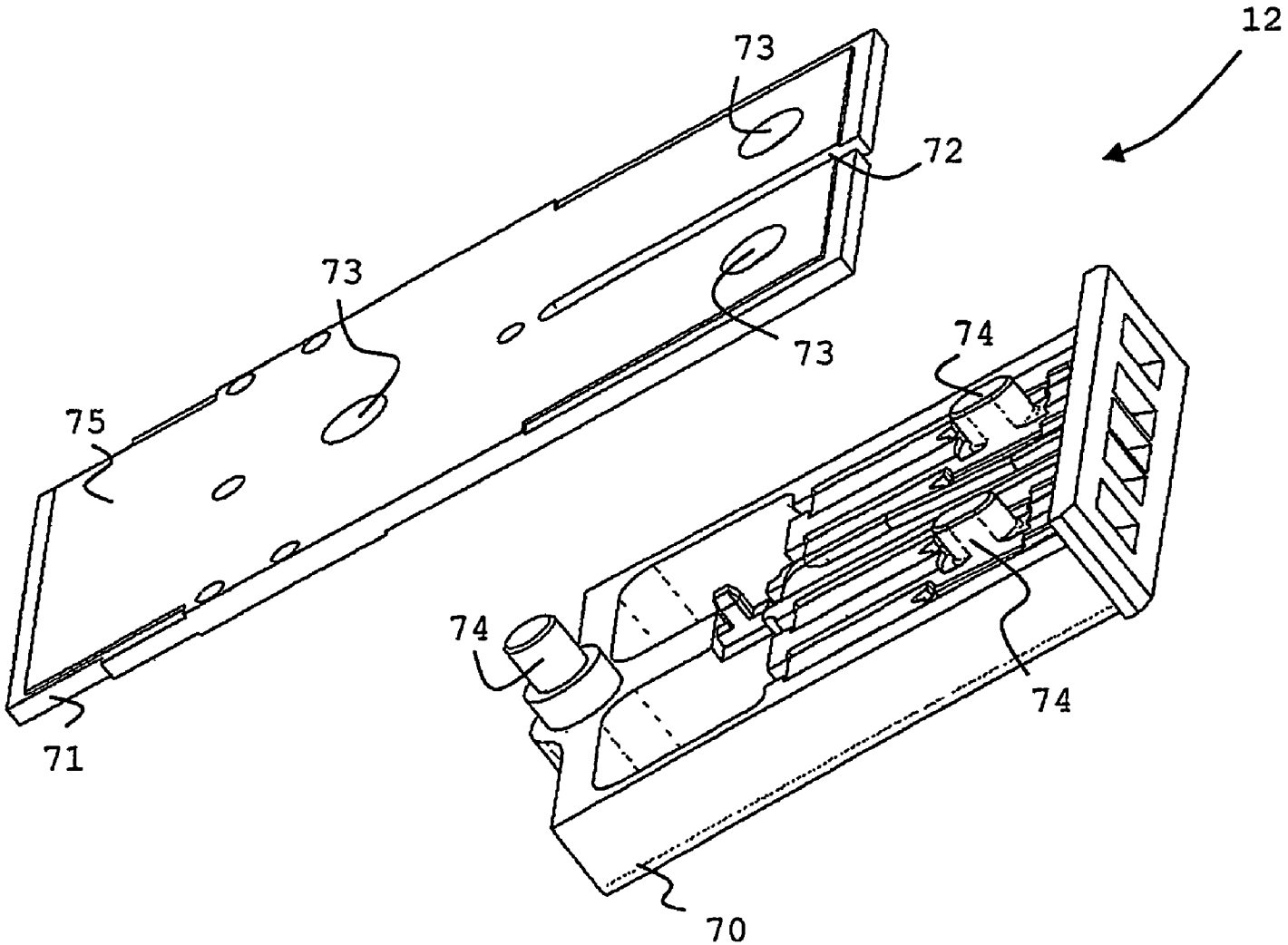
Figure 8:
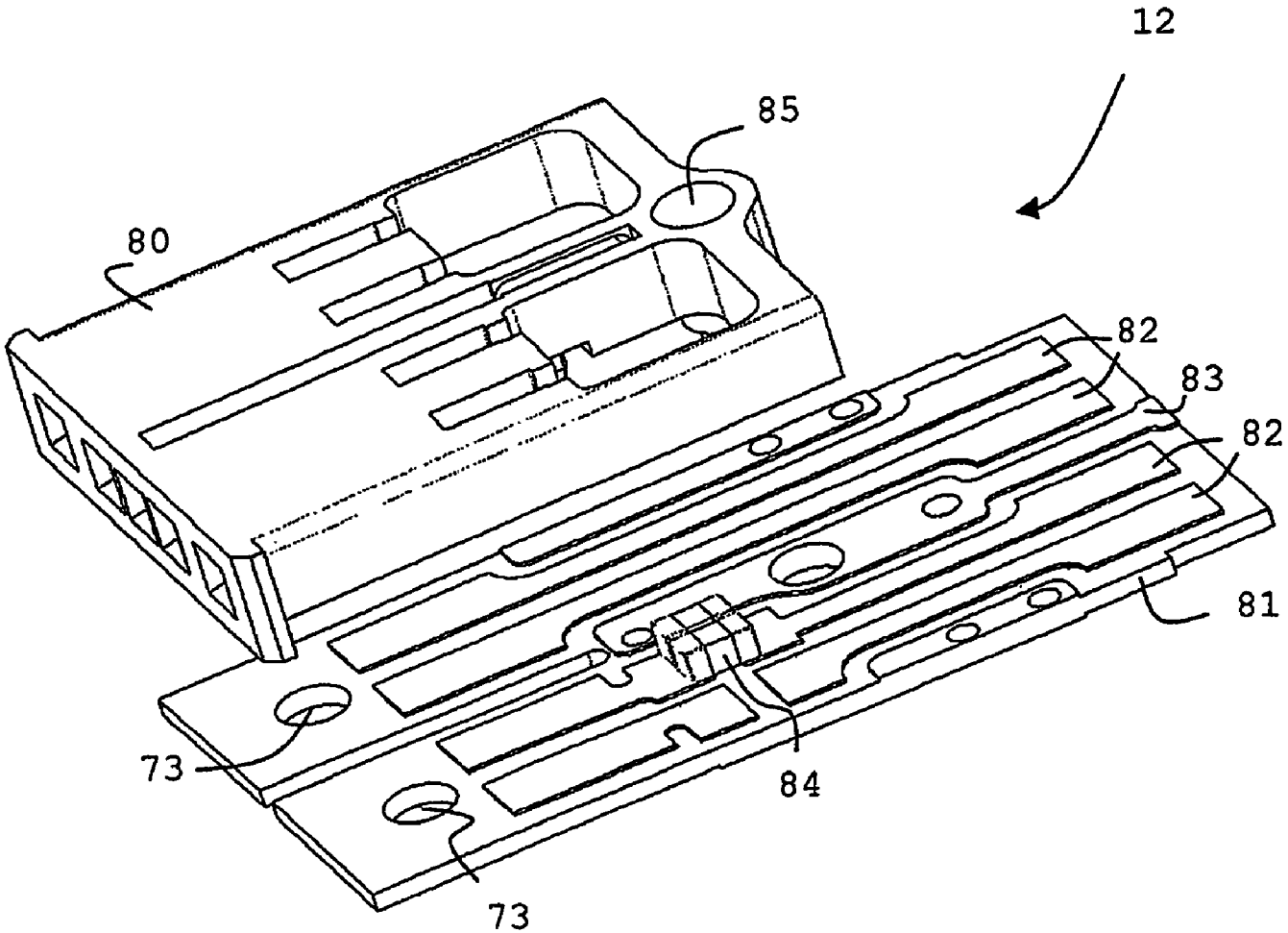

FIGS. 6-8 show various embodiments of connecting means 12. FIG. 6 displays two views of a plastic connecting block 60 of connecting means 12, comprising signal contacts 62 and a ground contact 63 constituted as dual beam terminals and a fork contact respectively. Connecting block 60 comprises protrusions 64 and holes 65 that are adapted to cooperate with protrusions 64 of a subsequent connecting block 60. The connecting means 12 may be adapted to include a wafer providing signal and ground tracks as will be shown next for alternative connecting blocks. Protrusions 64 of the connecting block 60 that is positioned first in the connecting portion 32 may cooperate with a hole 40 of the die-cast base 2.

FIG. 7 shows connecting means 12 with an alternative connecting block 70 and a wafer 71 for termination of the cable wires 11 of the cable 5. Wafer 71 is provided with a groove 72 for receiving the ground fork contact 63 and various holes 73 that are adapted to cooperate with the protrusions 74 of the connecting block 70. Protrusions 74 of the first positioned connecting block 70 may cooperate with the receiving means 40. Moreover wafer 71 is provided with a copper plate 75 for shielding purposes that is contacted via the holes 73 with the ground contact 63.

FIG. 8 shows alternative connecting means 12 comprising connecting block 80 and a wafer 81, having signal tracks 82 and a ground track 83. The signal tracks 82 of the wafer 81 may be connected to electrical means 84, such as equalization or passive filters. The hole 85 of the connecting block 80 may receive one of the protrusions 74 of a below connecting block 70 via the suitable hole 73 in the wafer 71 and/or of the receiving means 40, such as a pillar, in the connecting portion 32 of the die-cast base 2 of the cable connector 1.

It should be appreciated that other alternatives for positioning and mounting of the connecting means 12 in the cable connector are possible without departing from this element of the scope of the invention. It can e.g. be envisaged that the second portion 10 of the die-cast base 2, e.g. in the connecting means portion 32, comprises one or integral pillars as reception means 40 adapted to extend through corresponding holes of the connecting blocks 60, 70, 80 and wafers 71, 81. Metal sheet formed housing 8 may comprise recesses or holes to receive these integral pillars 40.

Figure 9:
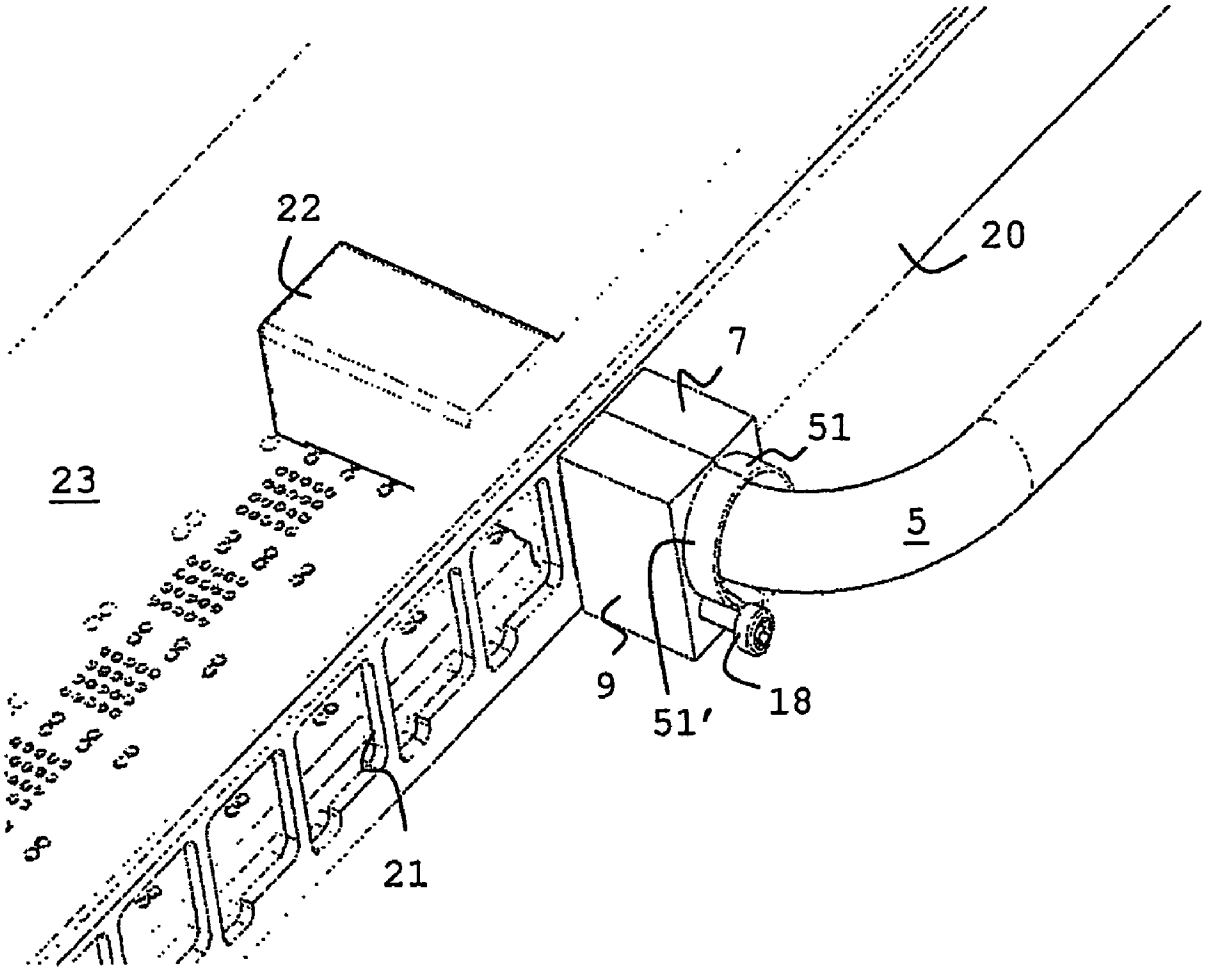
FIG. 9 shows a cable connector according to an embodiment of the invention connected to a front panel.

In FIG. 9 cable connector 1 is shown connected to a header assembly 22 on a board 23 behind the front panel 20.

We claim:

1. Cable connector comprising a housing having a die-cast base substantially extending between a front side and a rear side of said connector characterized by a die-cast first housing part mounted to said die-cast base such that said die-cast first housing part and a first portion of said die-cast base determine a first cable connector portion at said rear side;

a formed metal sheet second housing part mounted to said die-cast base such that said formed metal sheet second housing part and a second portion of said die-cast base determine a second cable connector portion at said front side, wherein said front side does not comprise said die-cast first housing part.

2. Cable connector according to claim 1, wherein said die-cast first housing part is a modular first housing part and said first cable connector portion comprises a ferrule holder portion.

3. Cable connector according to claim 1, wherein said first cable connector portion comprises a cable entrance opening at said rear side and a shaft outwardly protruding from said first cable connector portion.

4. Cable connector according to claim 1, wherein said second portion of said die cast base comprises a wire management portion and a connecting means with reception means adapted for receiving said connecting means.

5. Cable connector according to claim 1, wherein said cable connector comprises connecting means at said front side with one or more wafers, said wafers comprising a plurality of signal tracks and/or ground tracks for termination of cable wires.

6. Cable connector according to claim 1, wherein said formed metal sheet second housing part comprises one or more protrusions for mounting said formed metal sheet second housing part to said die-cast first housing part.

7. Cable connector according to claim 1, wherein said formed metal sheet second housing part comprises spring contacts adapted to be received by said first portion of said die-cast base.

8. Cable connector according to claim 1, wherein said formed metal sheet second housing part is a modular second housing part and said second portion of said die-cast base comprises a receiving structure for said second housing part.

9. Cable connector according to claim 8, wherein the wall thickness of said second portion of said die-cast base is approximately 0.4 -0.6 mm.

10. Cable connector according to claim 1, wherein said second cable connector portion comprises an opening at said front side and connecting means located within said second cable connector portion with respect to at least one edge determining said opening.

11. Cable connector according to claim 4, wherein said connecting means comprises one or more connecting blocks, said connecting blocks comprising protrusions and/or holes adapted to cooperate with said reception means.

12. Cable connector according to claim 11, wherein said connecting means further comprises one or more wafers associated with said connecting blocks, said wafers comprising holes to cooperate with said protrusions and/or said reception means.

13. Cable connector according to claim 12, wherein said wafers comprise a shielding plane on a side opposite to the side of said signal and/or ground tracks.

14. Cable connector according to claim 1, wherein said die-cast base comprises one or more ridges.

15. Cable connector according to claim 14, wherein said ridges are located in at least a part of said second portion of said die-cast base extending in an axial direction of said cable connector.

16. Cable connector according to claim 15, wherein said part of said second portion of said die-cast base is a wire management portion.

17. Cable connector according to claim 15, wherein at least one of said ridges in the connecting portion of the die-cast base of the cable connector comprises one or more protrusions extending from said ridge in a direction substantially perpendicular to said axial direction.

18. Method of assembling a cable to a cable connector according to claim 1, comprising the steps of:

providing a cable having a cable ferrule in said first portion of said die-cast base;

mounting said formed metal sheet second housing part to said second portion of said die-cast base;

mounting said die-cast first housing part to said first portion of said die-cast base while clamping protrusions of said formed metal sheet second housing part between said cable ferrule and said die-cast first housing part.

19. Method according to claim 18, further comprising the step of cutting cable wires of said cable to an appropriate length with respect to signal tracks of one or more wafers of connecting means of said cable connector after positioning said ferrule in said die-cast base.

20. Method according to claim 19, wherein said cable wires are cut slightly larger than the distance between said ferrule and wire termination parts of said signal tracks.

21. Formed metal sheet housing part for a cable connector, said formed metal sheet housing part being configured to be connected to a die-cast base substantially extending between a front side and a rear side of said cable connector and a die-cast housing part adapted to be mounted to said die-cast base to form the cable connector, wherein said formed metal sheet housing part is adapted to be mounted to said die-cast base and said die-cast housing part, and wherein said formed metal sheet housing part is configured to form a top side of said front side with said die-cast base forming a bottom side of said front side.

22. Formed metal sheet housing part according to claim 21, wherein said part comprises protrusions for mounting said part to said die-cast housing part.

23. Formed metal sheet housing part according to claim 21, wherein said part comprises spring contacts.

24. Formed metal sheet housing part according to claim 21, wherein said housing part has a U-shape.

25. An electrical connector housing comprising:

a die-cast base substantially extending between a front end and a rear end of the connector housing, wherein the die-cast base comprises a front portion and rear portion;

a die-cast first housing part mounted to the die-cast base such that the die-cast first housing part and a first portion of the die-cast base determine a first connector portion at the rear end; and a formed metal sheet second housing part mounted to the die-cast base such that the formed metal sheet second housing part and a second portion of the die-cast base determine a second connector portion at the front end, wherein the front end of the connector housing comprises an enclosure formed by the second housing part at least partially forming three side of the enclosure and the front portion of the die-cast base forming a fourth side of the enclosure configured to capture connector blocks therebetween.

26. An electrical connector housing as in claim 25 wherein the first housing part and the base comprise a same material, and the second housing part comprises a material different than the first housing part and the base.

27. An electrical connector housing comprising:

a die-cast base substantially extending between a front end and a rear end of the connector housing, wherein the die-cast base comprises a front portion and rear portion;

a die-cast first housing part mounted to the die-cast base such that the die-cast first housing part and a first portion of the die-cast base at least partially form the rear end; and a second housing part formed of metal sheet and mounted to the die-cast base such that the second housing part and a second portion of the die-cast base at least partially form the front end, wherein the connector housing comprises a top side and a bottom side, wherein the top side is formed by the first and second housing parts and does not include the base, and wherein the bottom side is formed by the base and does not include the first and second housing parts.

28. An electrical connector housing as in claim 27 wherein the first housing part and the base comprise a same material, and the second housing part comprises a material different than the first housing part and the base.

* * * * *